US012473740B2

(12) United States Patent
Lawson

(10) Patent No.: US 12,473,740 B2
(45) Date of Patent: Nov. 18, 2025

(54) ANCHOR FOR LANE LINES

(71) Applicant: Daldorado, LLC, Naples, FL (US)

(72) Inventor: Robert Lawson, Naples, FL (US)

(73) Assignee: DALDORADO, LLC, Naples, FL (US)

( * ) Notice: Subject to any disclaimer, the term of this patent is extended or adjusted under 35 U.S.C. 154(b) by 96 days.

(21) Appl. No.: 18/408,182

(22) Filed: Jan. 9, 2024

(65) Prior Publication Data

US 2024/0240480 A1 Jul. 18, 2024

Related U.S. Application Data

(60) Provisional application No. 63/438,739, filed on Jan. 12, 2023.

(51) Int. Cl.
*E04H 4/14* (2006.01)
*E04H 4/10* (2006.01)

(52) U.S. Cl.
CPC ..... *E04H 4/143* (2013.01); *E04H 4/145* (2013.01); *E04H 4/10* (2013.01); *E04H 2004/146* (2013.01); *E04H 2004/147* (2013.01)

(58) Field of Classification Search
CPC ..... E04H 4/143; E04H 4/145; E04H 4/10; E04H 2004/146; E04H 2004/147
USPC ..... 248/499
See application file for complete search history.

(56) References Cited

U.S. PATENT DOCUMENTS 1,691,480 A * 11/1928 Hirst ..... E02D 5/80 403/42
2,958,872 A * 11/1960 Meyer, Jr. ..... E04H 4/10 5/199
3,038,171 A * 6/1962 Bartolucci ..... E04H 4/10 4/503
3,065,576 A * 11/1962 Prizler ..... E04H 4/143 52/27
3,110,908 A * 11/1963 Newgard ..... E04H 4/10 52/711
3,414,226 A * 12/1968 Patnaude ..... E04H 4/10 52/166
3,520,004 A * 7/1970 Patnaude ..... E04H 4/10 24/265 R (Continued)

FOREIGN PATENT DOCUMENTS

CN 104420673 A * 3/2015 ..... E04H 4/143
CN 104420674 A * 3/2015 ..... E04H 4/143

(Continued)

OTHER PUBLICATIONS

Machine translation of KR 101347809 (Year: 2014).*
Machine translation of KR 102260515 (Year: 2021).*
Machine translation of KR 20200098899 (Year: 2020).*

*Primary Examiner* — Taylor Morris
(74) *Attorney, Agent, or Firm* — QUARLES & BRADY LLP

(57) ABSTRACT

An improved anchor for lane lines of swimming pools is provided. The anchor can include housing having a cover and a support member, the housing defining an internal cavity and the cover being movable to open and close the internal cavity. An extension connector can be configured to engage the support member. With the cover closed over the internal cavity, a first end of the extension member can be secured in engagement with the support member and a second end of the extension member can extend outside of the internal cavity to support a lane line.

18 Claims, 12 Drawing Sheets

(56) References Cited

U.S. PATENT DOCUMENTS 3,550,343 A * 12/1970 Buske ..... E04B 1/4142 410/112
3,556,457 A * 1/1971 Patnaude ..... F16B 45/023 410/101
3,575,372 A * 4/1971 Emberson ..... A63B 71/028 248/501
4,007,566 A * 2/1977 Molitor ..... E04H 4/1227 52/169.7
4,122,560 A * 10/1978 Baker ..... E04H 4/143 24/71.1
4,497,152 A * 2/1985 Weissner ..... E04H 4/141 52/166
4,834,015 A * 5/1989 Alpert ..... B63B 21/29 114/294
4,985,007 A * 1/1991 Ellis ..... E04H 4/143 4/496
5,005,229 A * 4/1991 Bertoni ..... E04H 4/143 52/707
5,104,273 A * 4/1992 Clark ..... E04H 4/14 52/704
5,184,377 A * 2/1993 Ragsdale ..... F16B 13/0891 81/176.15
5,326,203 A * 7/1994 Cockrell ..... B62D 33/0207 410/106
6,416,265 B1 * 7/2002 Flores ..... B60P 7/0807 410/109
7,309,088 B2 * 12/2007 Fiore ..... E04H 4/1272 294/24
7,431,548 B2 * 10/2008 Acton ..... B60P 7/0807 410/112
7,811,036 B2 * 10/2010 Armour ..... B60P 7/0807 410/109
8,286,277 B2 * 10/2012 Tupper ..... E04H 4/108 4/503
8,713,889 B2 * 5/2014 Buttner ..... E04H 4/06 52/698
9,238,155 B2 * 1/2016 Borchardt ..... E04G 21/3295
9,359,779 B2 * 6/2016 Borchardt ..... F16M 13/02
10,077,570 B2 * 9/2018 Underwood ..... F16G 11/12
10,532,235 B2 * 1/2020 Linton ..... A62B 35/0068
11,306,457 B2 * 4/2022 Pickel ..... E02D 5/80
2006/0242924 A1 * 11/2006 Kwon ..... E04B 1/4142 52/707
2011/0265296 A1 * 11/2011 Perkins ..... E04G 21/328 24/595.1
2016/0289993 A1 * 10/2016 Volin ..... E04H 12/2292
2019/0390694 A1 * 12/2019 Green ..... F16B 5/07
2023/0250654 A1 * 8/2023 Head ..... E04G 21/3214 248/237

FOREIGN PATENT DOCUMENTS

FR 2478765 A1 * 9/1981 ..... E04H 4/143
KR 101347809 B1 * 1/2014 ..... E04H 4/14
KR 20160149713 A * 12/2016 ..... F16G 11/12
KR 20200098899 A * 8/2020 ..... E04H 4/145
KR 102260515 B1 * 6/2021 ..... E04H 4/14

* cited by examiner

ANCHOR FOR LANE LINES

CROSS-REFERENCE TO RELATED APPLICATIONS

This application claims the benefit of U.S. Provisional Patent Application No. 63/438,739, filed Jan. 12, 2023, and entitled, "Anchor for Lane Lines" which is herein incorporated herein by reference in its entirety.

FIELD

The present disclosure relates, in general, to an anchor used to secure lane lines in a swimming pool.

BACKGROUND

Lane lines of various designs can be used for swimming pools to designate areas for particular activities. For example, lane lines can be used in the context of swimming competitions, training sessions, and otherwise to designate particular lanes or other areas for particular swimmers or activities.

SUMMARY

Some embodiments of the disclosure provide an anchor for lane lines of a swimming pool. A housing can include a cover and a support member, the housing defining an internal cavity and the cover being movable to open and close the internal cavity. An extension connector can be configured to engage the support member. With the cover closed over the internal cavity, a first end of the extension member can be secured in engagement with the support member and a second end of the extension member can extend outside of the internal cavity to support a lane line.

In some cases, the extension connector includes a first hook that engages the support member and a second hook that engages the lane line. The first hook can be more closed than the second hook.

In various instances, the extension connector can further include a flattened central portion. The flattened central portion can extend to the outside of the housing to overlay a section of a deck between the anchor and the swimming pool. The flattened central portion can comprise an internal web structure. The internal web structure can be formed from a metallic webbing and the flattened central portion can further include an outer sheath at least partially surrounding the metallic webbing. The outer sheath can be formed from silicon.

In various cases, the support member includes a cross-member that extends laterally across the internal cavity.

In some instances, in a storage configuration, the housing receives the extension connector fully within the internal cavity. The housing can include one or more lateral supports and the extension connector can rest on the one or more lateral supports in the storage configuration.

In some cases, the housing is recessed into a deck or a gutter that surrounds the swimming pool. With the cover closed over the internal cavity, a top surface of the cover can be substantially flush with a top surface of the deck or a cover of the gutter.

In various instances, the cover is pivotably coupled to the housing.

In some embodiments, a method is provided for securing a lane line for a swimming pool. With a cover of the housing in an open configuration, the method can include securing a first end of an extension connector to a support member within an internal cavity of a housing. The method can continue by closing the housing to secure the first end of the extension connector within the internal cavity, in engagement with the support member, with a second end of the extension connector extending outside of the housing. The method can continue by securing a lane line to the second end of the extension member.

In various cases, securing the first end of the extension connector to the support member includes engaging a first hook of the extension connector with a lateral cross-member within the housing and securing the second end of the extension connector to the lane line includes engaging a second hook of the extension connector to the lane line.

In some embodiments, a method is provided for installing an anchor for a lane line of a swimming pool. The method can include providing the anchor comprising: a housing that includes a cover and a support member, the housing defining an internal cavity and the cover being movable to open and close the internal cavity and an extension connector configured to engage the support member. The method can continue by drilling one or more drill holes into a selected location relative to the swimming pool and aligning one or more holes of a housing of the anchor with the one or more drill holes. Next, the method can include inserting one or more fasteners into the one or more holes of the housing and the one or more drill holes.

In some cases, the method can include, with the cover of the housing in an open configuration, securing a first end of the extension connector to a support member within the internal cavity of the housing and closing the housing to secure the first end of the extension connector within the internal cavity, in engagement with the support member, with a second end of the extension connector extending outside of the housing.

In various instances, the method can include using a drilling template, drilling a first drill hole and a second drill hole of the one or more drill holes into a substrate that surrounds the swimming pool. Each of the first and second drill holes can extend at a respective oblique angle relative to vertical. In some cases, the method can include before aligning a first hole and a second hole of the one or more holes of the housing with the first and second drill holes, inserting fastening anchors into the first and second drill holes.

DETAILED DESCRIPTION

Figure 1A:
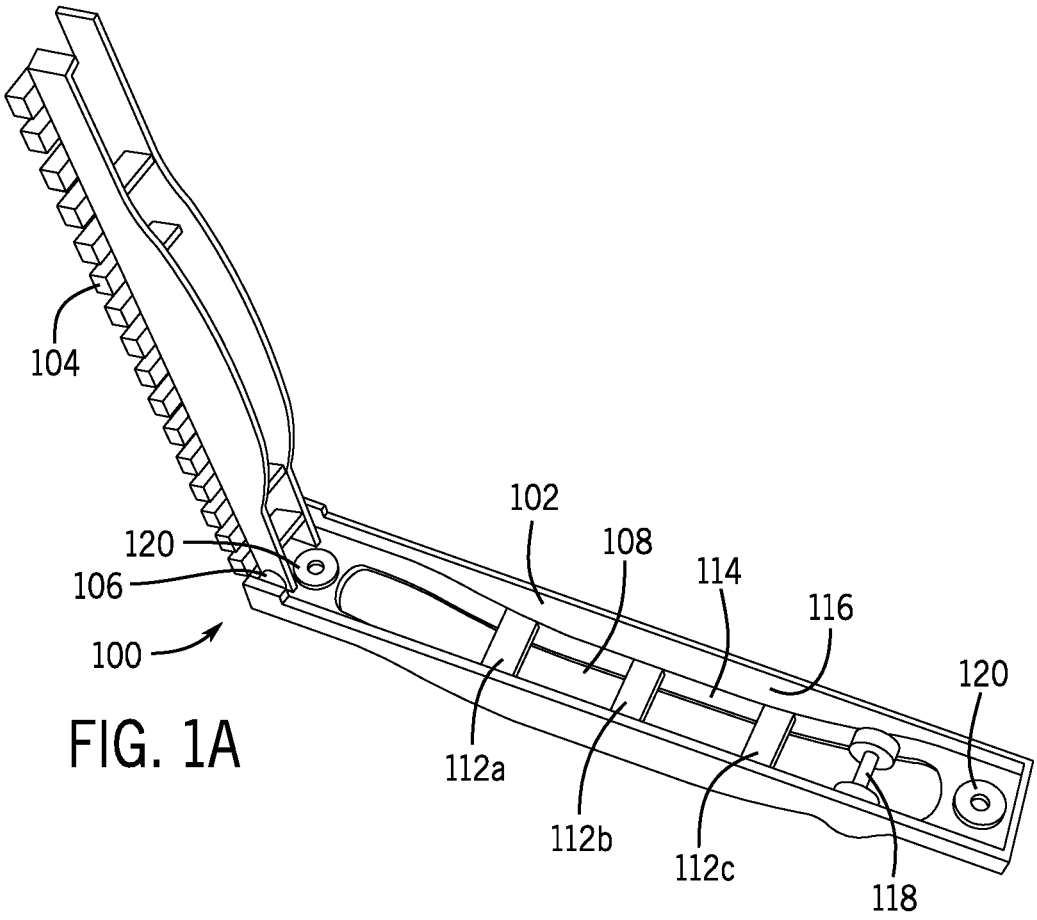
FIG. 1A is a perspective view of a housing of a lane line anchor in open configuration, in accordance with an example of the disclosed technology.

Before any embodiments of the disclosure are explained in detail, it is to be understood that the disclosure is not limited in its application to the details of construction and the arrangement of components set forth in the following description or illustrated in the following drawings. The disclosure is capable of other embodiments and of being practiced or of being carried out in various ways. Also, it is to be understood that the phraseology and terminology used herein is for the purpose of description and should not be regarded as limiting.

The following discussion is presented to enable a person skilled in the art to make and use embodiments of the disclosure. Various modifications to the illustrated embodiments will be readily apparent to those skilled in the art, and the generic principles herein can be applied to other embodiments and applications without departing from embodiments of the disclosure. Thus, embodiments of the disclosure are not intended to be limited to embodiments shown, but are to be accorded the widest scope consistent with the principles and features disclosed herein. The following detailed description is to be read with reference to the figures, in which like elements in different figures have like reference numerals. The figures, which are not necessarily to scale, depict selected embodiments and are not intended to limit the scope of embodiments of the disclosure. Skilled artisans will recognize the examples provided herein have many useful alternatives and fall within the scope of embodiments of the disclosure.

Some of the discussion below describes an anchor that can be used to secure lane lines in a swimming pool. The context and particulars of this discussion are presented as examples only. For example, embodiments of the disclosure can be configured in various ways, including with other shapes and arrangements of elements that are expressly described or illustrated. Similarly, embodiments of the disclosure can be used with arrangements of swimming pools, swimming pool decks, swimming pool gutters, or other assemblies other than those expressly illustrated or described herein.

Lane lines of various designs can be used for swimming pools to designate areas for particular activities (e.g., swimming competitions, training sessions, water polo competitions, and otherwise to designate particular lanes or other areas for particular swimmers or activities). Lane lines typically require some type of lane securement device to secure the lane lines to a surrounding surface (e.g., a swimming pool deck, a swimming pool gutter, or the like). The lane securement device can be utilized to ensure that the lane lines do not float away and that the lane lines maintain a particular shape or stay in a particular location. However, conventional lane securement devices can often be placed at locations where the lane securement devices protrude substantially above a surrounding surface and thus impede free movement of people or objects on the surrounding surface. Further, conventional lane securement devices may require bonding per the National Electrical Code (NEC) 680.26(B)(5) due to the inclusion of sizable metal fittings (e.g., over 100 millimeters in one or more dimensions) or significant penetration into the pool structure (e.g., by more than 25 millimeters). Additionally, because conventional bonding involves a fixed bonding element (e.g., a bonding lug and copper wiring) extending through the pool shell, the lane securement devices must typically be placed in a fixed location relative to the bonding element.

Embodiments of the disclosure can address these or other issues. For example, the disclosed lane line securement device or anchor can include a housing that sits flush with a surrounding surface (e.g., a swimming pool deck, a swimming pool gutter, or the like). The anchor can thus provide an improvement over conventional lane securement devices that may protrude substantially above a surrounding surface and thus impede free movement of people or objects on the surrounding surface. Further, examples of the disclosed anchor may not require any bonding per NEC 680.26(c), and can be positioned with great flexibility, depending on the needs of a particular installation. For example, a housing of the anchor can be formed from polyvinyl chloride (PVC) or other plastic and accordingly not require any bonding because the housing is not metallic. Additionally, because bonding may not be required, the housing of the anchor may not need to be placed in a fixed location relative to a bonding element. Instead, the housing of the anchor can be flexibly placed at various locations along the perimeter of the pool.

Figure 1B:
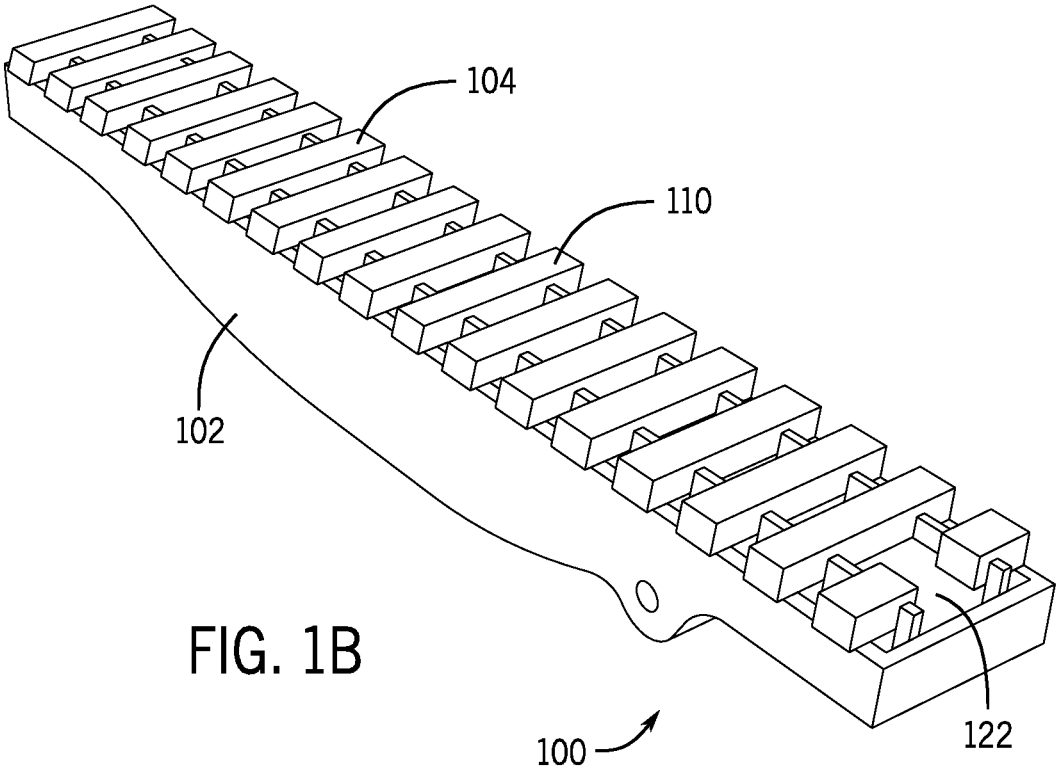
FIG. 1B is a perspective view of the housing of FIG. 1A in a closed configuration.

FIGS. 1A and 1B illustrate a housing 100 of an improved anchor that can be used to secure lane lines or other components for swimming pools. FIG. 1A shows the housing 100 in an open configuration while FIG. 1B shows the housing 100 in a closed configuration.

In particular, the housing 100 can include a housing body 102 and a cover 104. In various instances, the housing body 102 can be a variety of lengths and shapes and configured (e.g., sized, shaped, or the like) to fit within or otherwise match a variety of surrounding surfaces or to house a variety of extension connectors (or other components). In some cases, the housing 100 including the housing body 102 and the cover 104 can be formed from polyvinyl chloride (PVC) or other plastic or non-metallic material.

In some embodiments, the cover 104 can be coupled to the housing body 102. In some cases, the cover 104 can be coupled to the housing body 102 via a pivoting connection—e.g., a hinged connection 106 or other pivotable structure. Thus, for example, cover 104 can be configured to be opened (e.g., as shown in FIG. 1A) and closed (e.g., as shown in FIG. 1B).

In the open configuration, the cover 104 can reveal and provide access to an internal cavity 108 within the housing body 102. The internal cavity 108 can be sized to fully receive or fully enclose an extension connector (e.g., an extension connector 200*a*, 200*b* as further discussed below, or the other extension connector).

In the closed configuration, the cover 104 can be closed to at least partly block access to the internal cavity 108. In some examples, when the cover 104 is closed, a top surface 110 of the cover 104 can be configured to be flush with a surrounding surface (e.g., a swimming pool deck, a swimming pool gutter cover, or the like) that surrounds the housing 100. The housing 100 can thus provide an improvement over conventional designs that may protrude substantially above a surrounding surface and correspondingly impede free movement of people or objects on the surrounding surface.

Additionally, the illustrated housing 100 may not require any bonding per NEC 680.26(c), and can be positioned with great flexibility, depending on the needs of a particular installation. For example, a housing of the anchor can be formed from PVC or other plastic and may not require any bonding because it is not metallic. Additionally, because the housing 100 on the anchor is not metallic, the housing 100 of the anchor does not need to be placed in a fixed location relative to a bonding element. Instead, the housing of the anchor can be flexibly placed at various locations along the perimeter of the pool.

The housing 100 can further include one or more extensions 112*a*-112*c* (collectively, extensions 112) that can be coupled to a bottom surface 114 or an interior wall 116 of the housing body 102, or otherwise supported relative to the cavity 108. In various instances, the one or more extensions 112 can extend (e.g., laterally extend) across the internal cavity 108. In some cases, the housing 100 can include more or fewer extensions 112 than are shown. Generally, the extensions can be configured in various ways, including as one or more bars, one or more beams, one or more poles, one or more rods, one or more rails, or other support or extension structures, or the like.

The housing 100 can further include a support member 118 coupled to the bottom surface 114 or the interior wall 116 of the housing body 102 or otherwise supported relative to the cavity 108. In various instances, the support member 118 can extend (e.g., laterally extend) across the internal cavity 108. Generally, the support member 118 can be configured in various ways, including as a cross-member, a rod, a bar, a pole, an extension, a beam, a rail, or other rigid support structure, or the like. In some examples, the housing 100 can be formed from a composite material (e.g., various known plastic polymers) and the support member 118 can be a metallic material that secured into the housing 100 by overmolding or in various other ways.

In some embodiments, the housing body 102 can further include one or more holes 120 in the bottom surface 114 or an interior wall 116 of the housing body 102. The one or more holes 120 can be configured to receive one or more screws, one or more bolts, or the like to couple the housing body 102 to a surrounding surface (e.g., a swimming pool deck, a swimming pool gutter, or the like)—e.g., via engagement with a concrete or other substrate of the surface.

In various instances, the cover 104 can further include an opening 122 located near or on a same side of the housing body 102 as the support member 118. As further discussed below, an extension connector (e.g., as described below with respect to FIGS. 2A-2D) can be configured to couple to support member 118, extend through the opening 122, and thereby couple the housing 100 to a lane line located in a swimming pool.

Figure 2A:
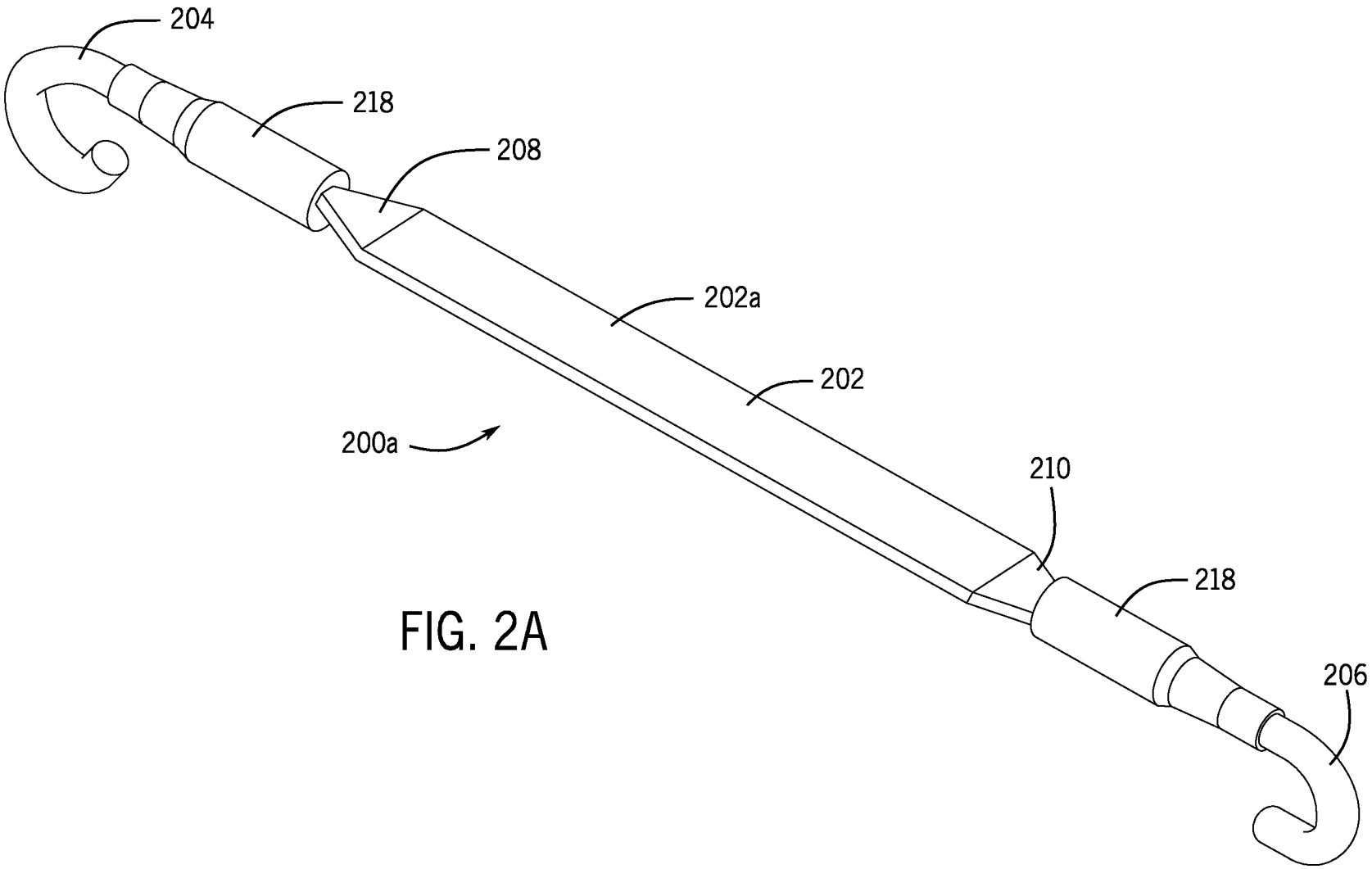
FIG. 2A is a perspective view of an example extension connector for use with the housing of FIGS. 1A and 1B, in accordance with an example of the disclosed technology.
Figure 2B:
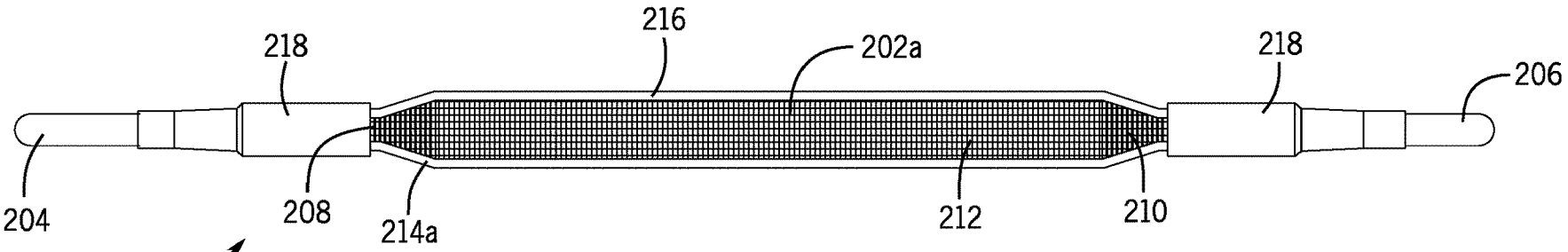
FIG. 2B is a top view of the extension connector of FIG. 2A.
Figure 2C:
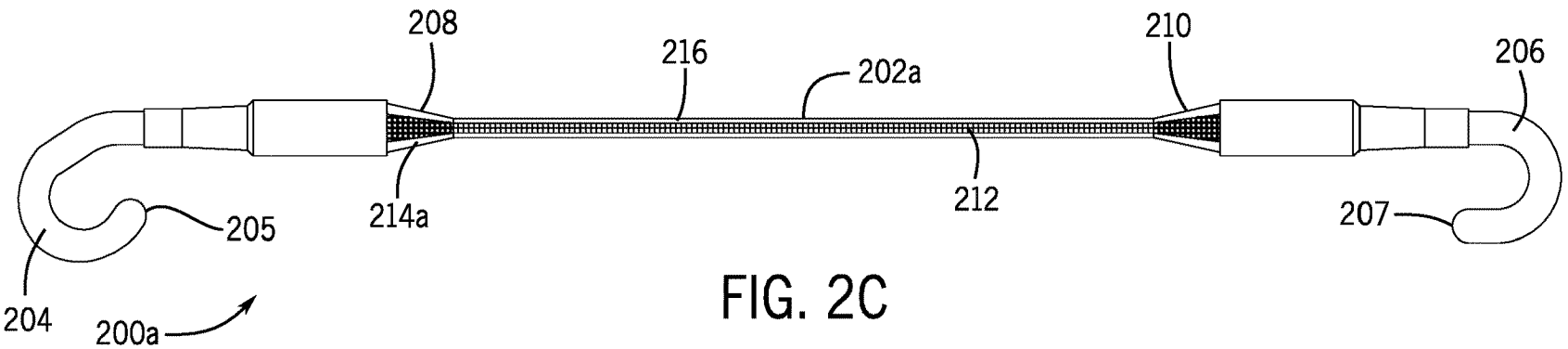
FIG. 2C is a side view of the extension connector of FIG. 2A.
Figure 2D:
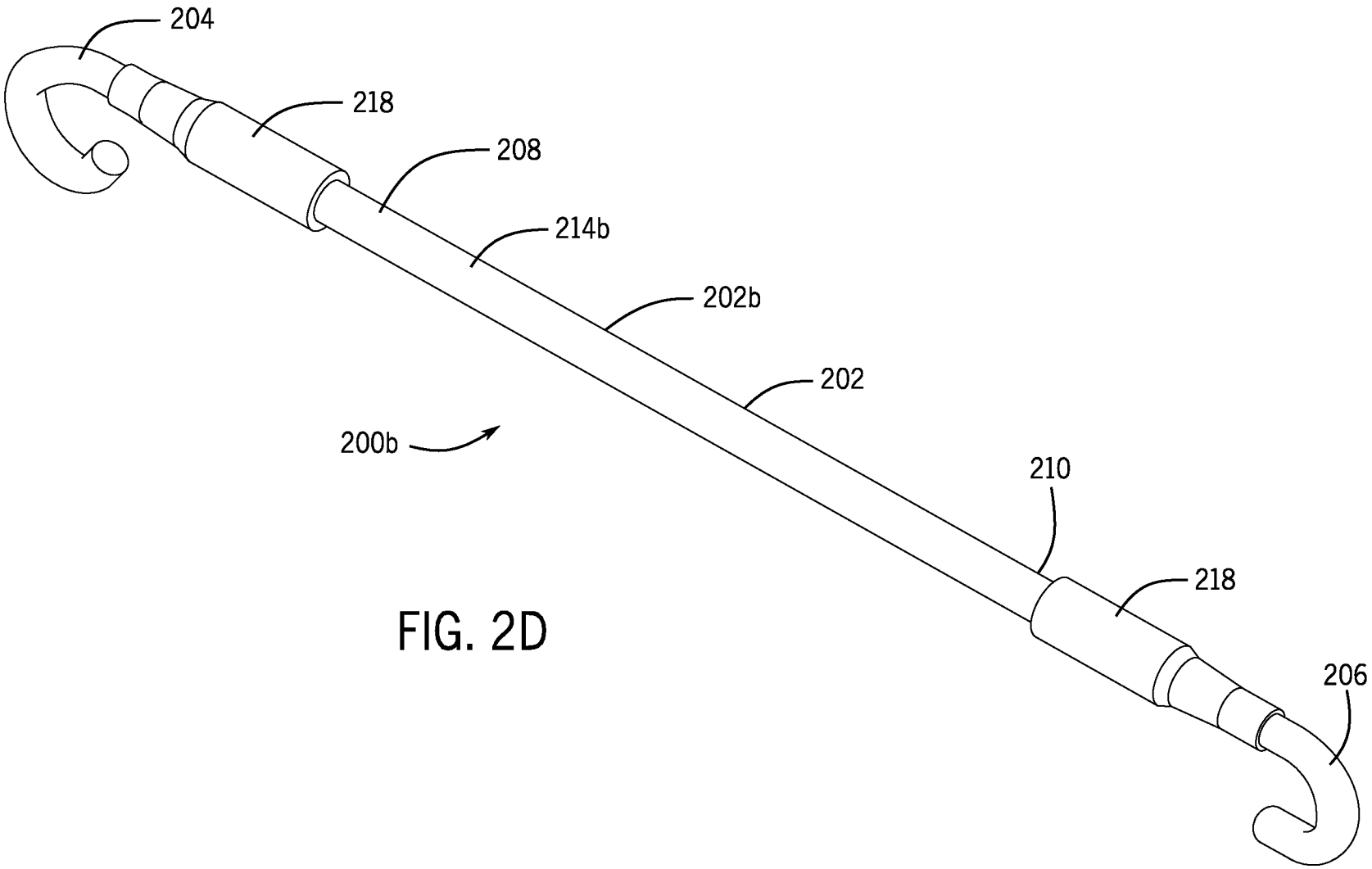
FIG. 2D is a perspective view of another example extension connector for use with the housing of FIGS. 1A and 1B, in accordance with an example of the disclosed technology.

FIGS. 2A-2C show an example extension connector 200*a* that can be housed within the housing body 102 of the housing 100 and removably coupled to a lane line of a swimming pool. FIG. 2D shows an example extension connector 200*b* that can be housed within the housing body 102 of housing 100 and removably coupled to a lane line of a swimming pool. Although two embodiments of the extension connector 200*a* and 200*b* are shown in FIGS. 2A-2D, a person of ordinary skill in the art will understand that other varieties of extension connectors are possible and within the scope of this disclosure.

The extension connectors 200*a* and 200*b* (collectively, extension connectors 200) can include an elongate central portion 202 with one or more connectors 204 and 206 located at opposing ends 208 and 210 of the elongate central portion 202. The connectors 204 and 206 can be one or more hooked connectors. The connectors 204 and 206 can be configured to removably couple to a support member 118 of the housing 100 or a lane line of a swimming pool. In various cases, a first connector 204 can be configured to connect to the support member 118 of the anchor and a second connector 206 can be configured to connect to the lane line. The connectors 204 and 206 can be formed from stainless steel (e.g., 316SS, or the like) or from other materials.

In various cases, the first connector 204 can have a first connector end 205 and the second connector 206 can have a second connector end 207. In some embodiments, the first connector end 205 can be closer to the elongate central portion 202 than the second connector end 207. In some cases, the first connector end 205 can be configured to point toward the elongate central portion 202 while the second connector end 207 can be configured to be parallel or about parallel with the elongate central portion 202.

In some cases, the first connector 204 (e.g., hook or the like) can be more closed, than the second connector 206 (e.g., hook or the like). In other words, a clearance to receive a lane line or support member into the first connector 204 can be smaller than a clearance to receive a lane line or support member into the second connector 206. Accordingly, for example, an object of a given width (e.g., a pin, lane line portion, etc.) can be more readily inserted into or removed from the second connector 206, via the corresponding clearance, than the first connector 204. For example, in the illustrated example, an opening into the hook formed by the connector 204 can provide a smaller clearance at an entrance area into the hook than an opening into the hook formed by the connector 206. By having the first connector 204 be more closed than the second connector 206, the extension connector 200 can be more securely anchored to support member 118 and prevented from sliding off support member 118. Further, by having the second connector 206 be more open than the first connector 204, the second connector 206 can be more easily coupled to (or decoupled from) a lane line.

In the illustrated example of FIGS. 2A-2C, the elongate central portion 202 can be a flattened central portion 202*a*. In some cases, the flattened central portion 202*a* can have an internal web structure 212 (shown in FIGS. 2B and 2C) surrounded by an outer sheath 214*a*. In some instances, the outer sheath 214*a* can completely surround the web structure 212 (e.g., so as to fully electrically insulate any conductive material within the web structure 212). Alternatively, in other cases, only particular portions (e.g., a perimeter 216 of the web structure 212, or the like) of the web structure 212 can be surrounded by the outer sheath 214*a*. In other instances, the flattened central portion 202*a* can have a web structure 212 without the outer sheath 214*a* or the outer sheath 214*a* can be included without the internal web structure 212. In some cases, the web structure 212 can be formed from a stainless-steel webbing (e.g., 316SS, or the like) or other metallic material. In some embodiments, the outer sheath 214*a* can be formed from silicone or other flexible or soft sheathing (e.g., other insulators or composite materials).

In the illustrated example of FIG. 2D, the elongate central portion 202 can be a cylindrical central portion 202*b*. In some cases, the cylindrical central portion 202*b* can have an internal wire (e.g., wire, cable, line, or the like) (not shown) surrounded by an outer sheath 214*b*. In other cases, the cylindrical central portion 202*b* can have an internal wire without the outer sheath 214*b* or the outer sheath 214*b* can be included without the internal wire. In some cases, the internal wire can be formed from stainless steel (e.g., 316SS, or the like). In some embodiments, the outer sheath 214*b* can be formed from silicone or other flexible or soft sheathing.

Of note, the extension connector 200*a* of FIGS. 2A-2C having a flattened central portion 202*a* (e.g., and also an internal web structure 212) can help to reduce damage to surrounding surfaces (e.g., swimming pool structures or surfaces such as tile nosing, a swimming pool deck, a swimming pool gutter, or the like) in contrast to other extension connectors (e.g., extension connector 200*b* as shown for comparison in FIG. 2D). For example, due to the flattened configuration, the surface area of the central portion 202*a* that is in contact with a surrounding surface can be larger than if the central portion were instead cylindrical. Having a larger surface area can reduce the amount that the extension connector 200*a* moves during use and also generally decrease the pressure from the extension connector 200*a* on the relevant surrounding surface. Therefore, the configuration shown in FIGS. 2A-2C, and other flattened configurations, can reduce the amount of wear and tear to a surface surrounding the extension connector 200*a*. Further, having a flattened central portion 202*a* can also help to ensure freer movement of people or objects around the housing 100.

In various embodiments, to connect the connectors 204 and 206 to the elongate central portion 202, the internal web structure 212, outer sheath 214*a* or 214*b*, or internal wire can be directly connected to the connectors 204 and 206 (e.g., via glue, welding, or the like). Alternatively or additionally, heat shrink tubes 218 can be used to couple the internal web structure 212, outer sheath 214*a* or 214*b*, or internal wire to the connectors 204 and 206. The heat shrink tubes 218 can also be used to generally cover exposed (or other) metal portions of the extension connectors 200*a* or 200*b* and thereby provide electrical insulation. In other examples, however, other materials and configurations are possible.

Additionally, differently sized or shaped extension connectors are possible in other examples, including extension connectors with different lengths or thicknesses of the elongate central portion (e.g., different lengths or thicknesses of the internal web structure 212, outer sheath 214*a* or 214*b*, or internal wire, or the like). Similarly, some connectors can have differently sized or shaped hooked ends, clasped ends (e.g., having hooks with latches), etc. The extension connectors are not intended to be limited to only the embodiments shown in FIG. 2.

Figure 3A:
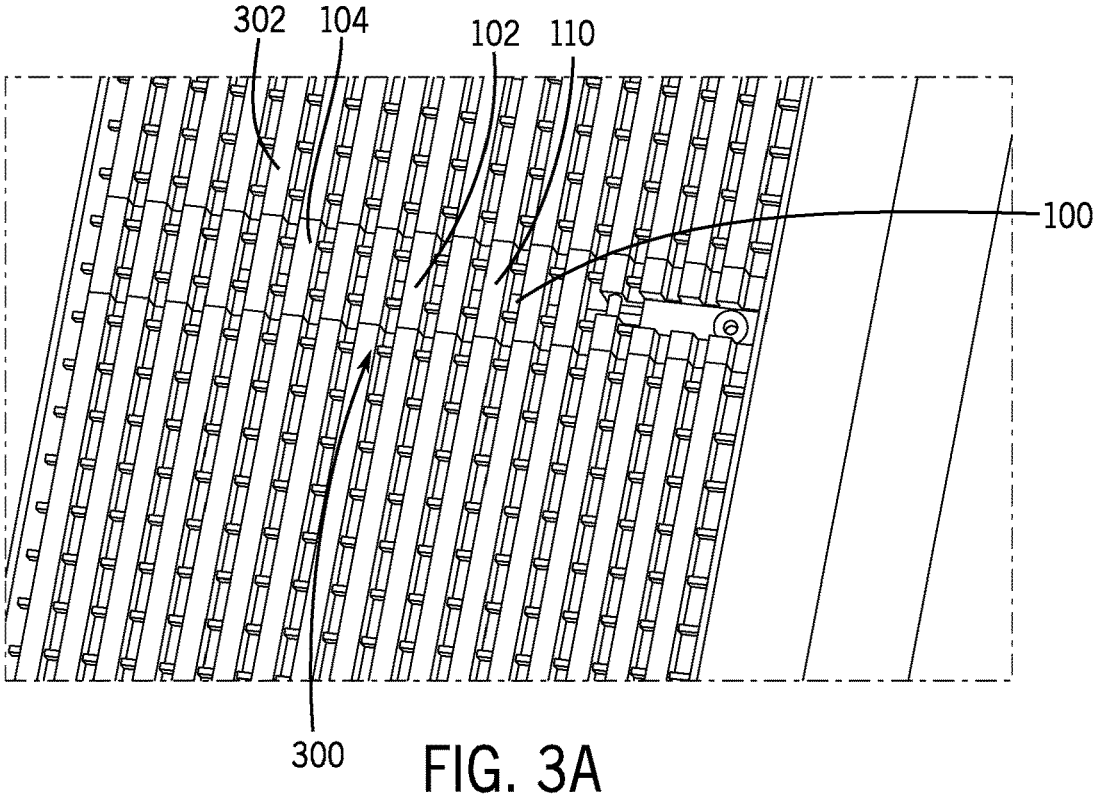
FIG. 3A shows a perspective view of an installed anchor that includes the housing of FIG. 1 with a cover closed and the extension connector of FIGS. 2A-2C in a storage configuration, in accordance with an example of the disclosed technology.
Figure 3B:
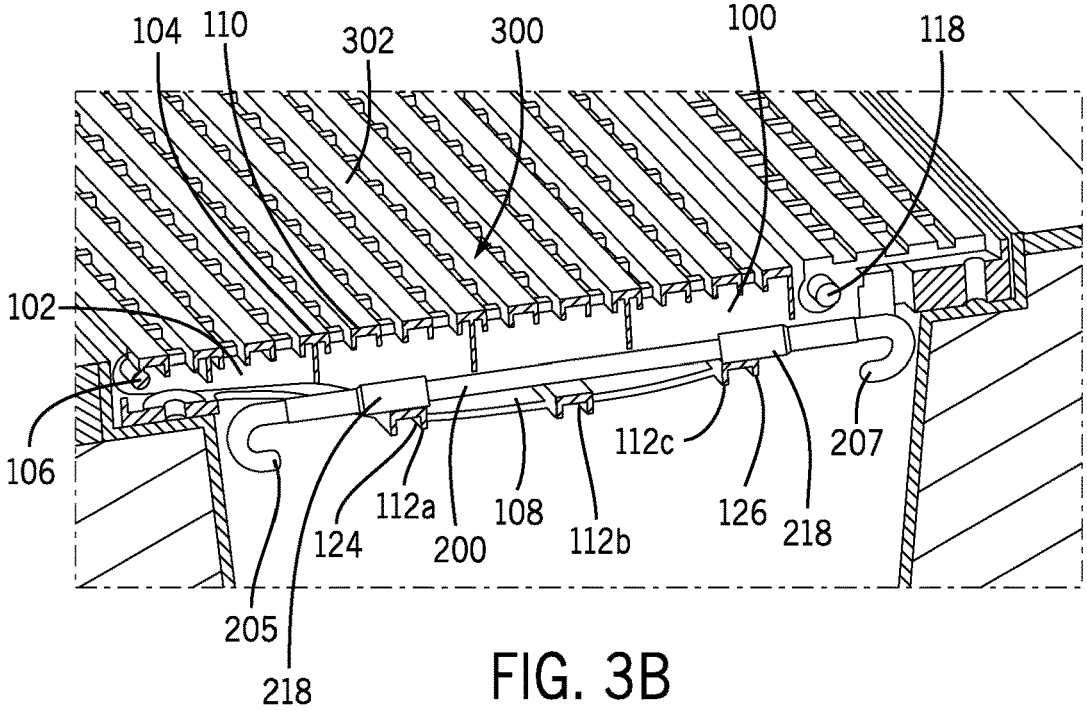
FIG. 3B shows a cross-sectional view of the installed anchor of FIG. 3A.
Figure 3C:
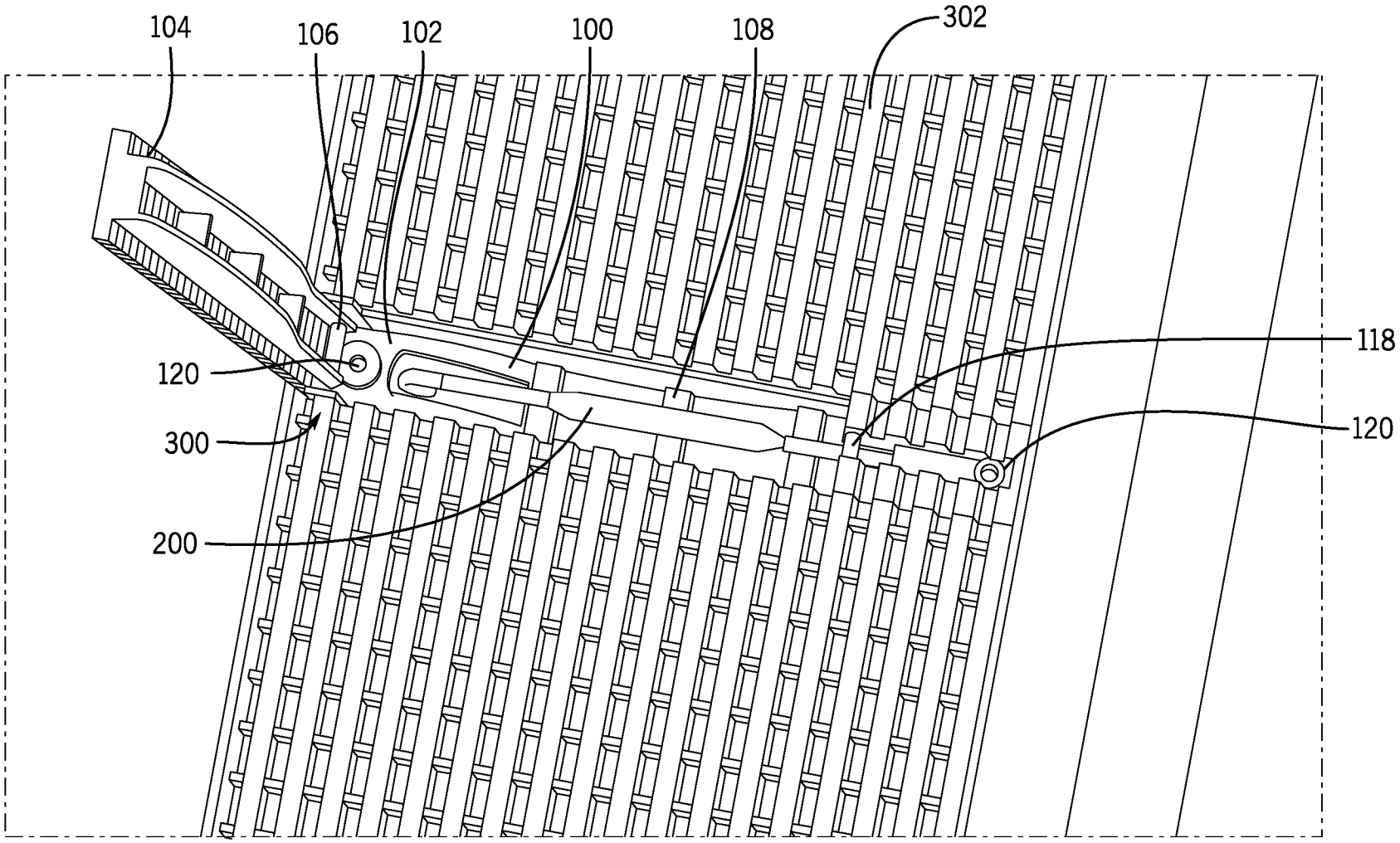
FIG. 3C shows a perspective view of the installed anchor of FIG. 3A with the cover opened.

Turning to FIGS. 3A-3C, FIGS. 3A-3C show an installed configuration of an anchor 300, in which the housing 100 of FIG. 1 is installed on a surrounding surface 302 in a storage configuration. As shown, the surrounding surface 302 includes a swimming pool gutter with a cover, although other configurations are possible (e.g., a swimming pool deck). FIGS. 3A and 3B show the housing 100 installed on the surrounding surface 302 in the storage configuration with the cover 104 of the housing body 102 closed while FIG. 3C shows the housing 100 installed on the surrounding surface 302 in the storage configuration with the cover 104 of the housing body 102 open.

As an initial note, the housing 100 can be installed in a variety of configurations on a surrounding surface 302 and can be positioned in a variety of selected locations. For example, one or more housings 100 can be configured or positioned to anchor standard lanes for swimming competitions, to anchor standard lane lines for water polo, or the like.

In the storage configuration, an extension connector 200 (e.g., extension connector 200*a*, 200*b*, or other extension connector) can be stored within an internal cavity 108 of the housing body 102 of the housing 100. In the storage configuration, the extension connector 200 can be easily stored for retrieval without risk of misplacing the extension connector 200. Additionally, the extension connector 200, when stored in the storage configuration, also does not impede free movement on the surrounding surface 302.

When the housing 100 is in the storage configuration and the cover 104 of the housing is closed as shown in FIGS. 3A and 3B, the top surface 110 of the cover 104 can be configured to be flush or at least substantially flush with the surrounding surface 302 surrounding the housing body 102 of the housing 100. Due to the cover 104 being flush or at least substantially flush with the surrounding surface 302, the cover 104 generally does not impede free movement on the surrounding surface 302. In this regard, the generally flush configuration of the housing 100—and the installed anchor 300—can be beneficially allow for installation of the anchor 300 in a wide variety of locations. (As used herein relative to a pool deck or other support surface, "substantially flush" indicates that at least part of a component is no more than 10 mm below the surface, and no part of the component extends more than 5 mm above the surface.)

In some embodiments, as shown in FIG. 3B, when the housing 100 is in the storage configuration, one or more portions of the elongate central portion 202 or heat shrink tubes 218 of the extension connector 200 can rest on top of the one or more lateral supports (e.g., integrally formed extensions 112*a*-112*c*). In the case of FIG. 3B, the heat shrink tubes 218 are configured to rest on top of the extensions 112*a* and 112*c*. Additionally, in some instances, a first connector end 205 of the connector 204 can be configured to extend past corresponding extension 112*a* and extend below a bottom surface 124 of the extension 112*a* and a second connector end 207 of the connector 204 can be configured to extend past corresponding extension 112*c* and extend below a bottom surface 126 of the extension 112*c*. By arranging the extension connector 200 in this way, the extension connector 200 can be prevented from falling out of the housing 100 when the extension connector 200 is installed in a surrounding surface (e.g., swimming pool deck, swimming pool gutter, or the like).

As shown in FIG. 3C, as needed, a cover 104 of the housing 100 can be pivoted open to remove the extension connector 200 from the housing body 102 of the housing 100. In various cases, the cover 104 of the housing 100 can be pivoted about the hinged connection 106. Once the cover 104 is opened, the extension connector 200 can then be installed in the housing 100 in an anchor configuration discussed with respect to FIGS. 4A-4D.

Figure 4A:
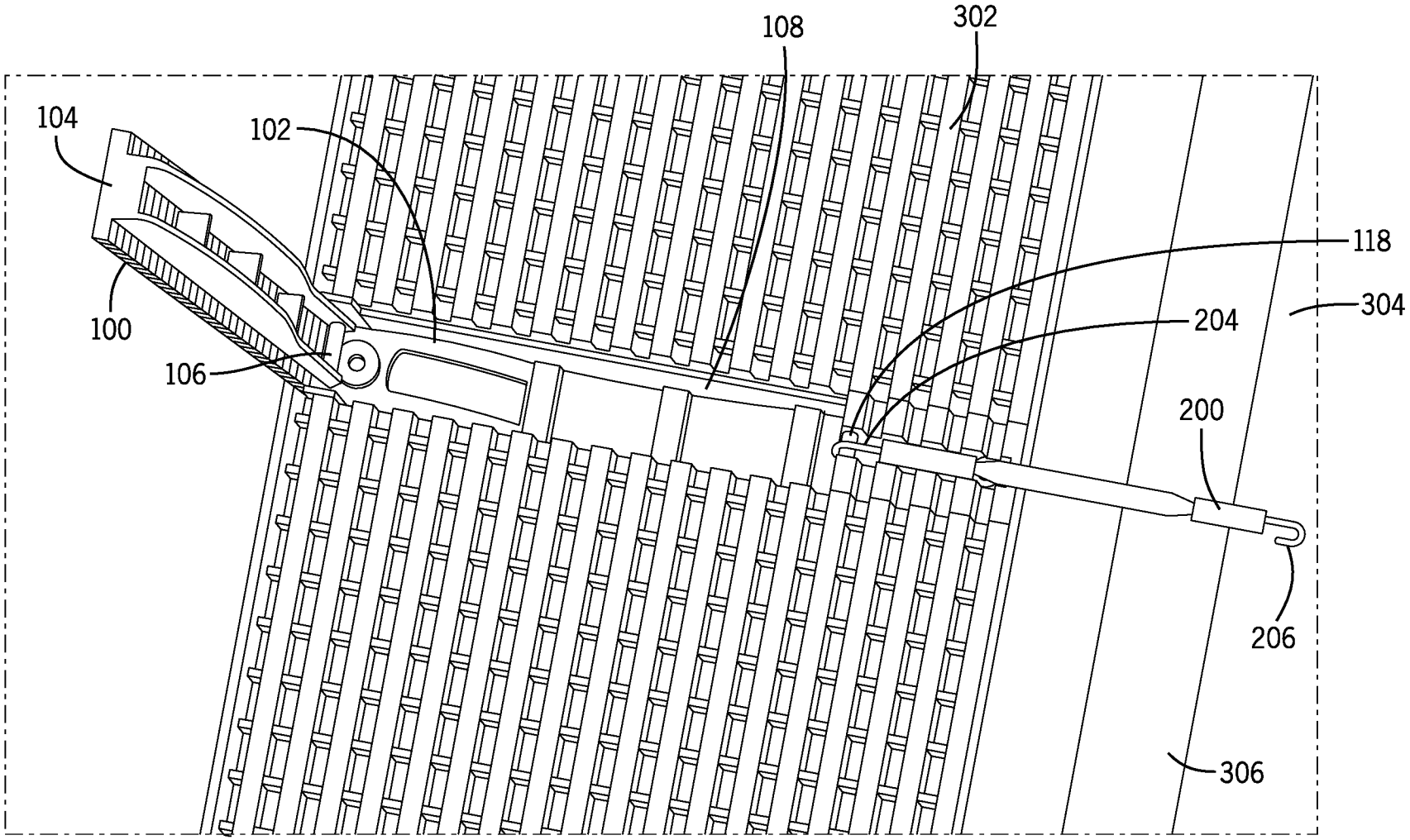
FIG. 4A shows a perspective view of the installed anchor of FIG. 3A, with the cover open and the extension connector installed to engage a lane line.
Figure 4B:
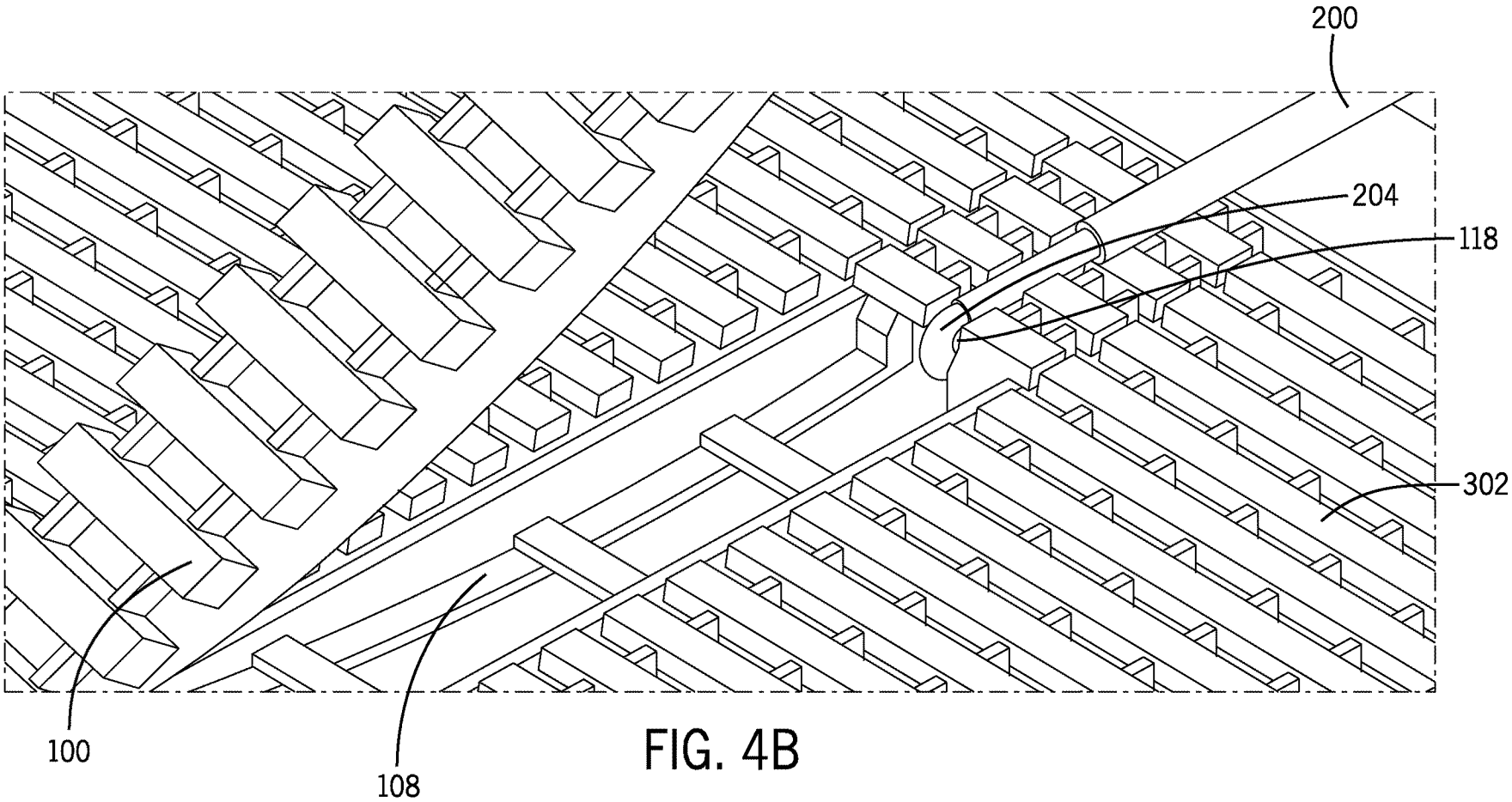
FIG. 4B shows a perspective partial view of the installed anchor of FIG. 3A, with the cover open and the extension connector installed to engage a lane line.
Figure 4C:
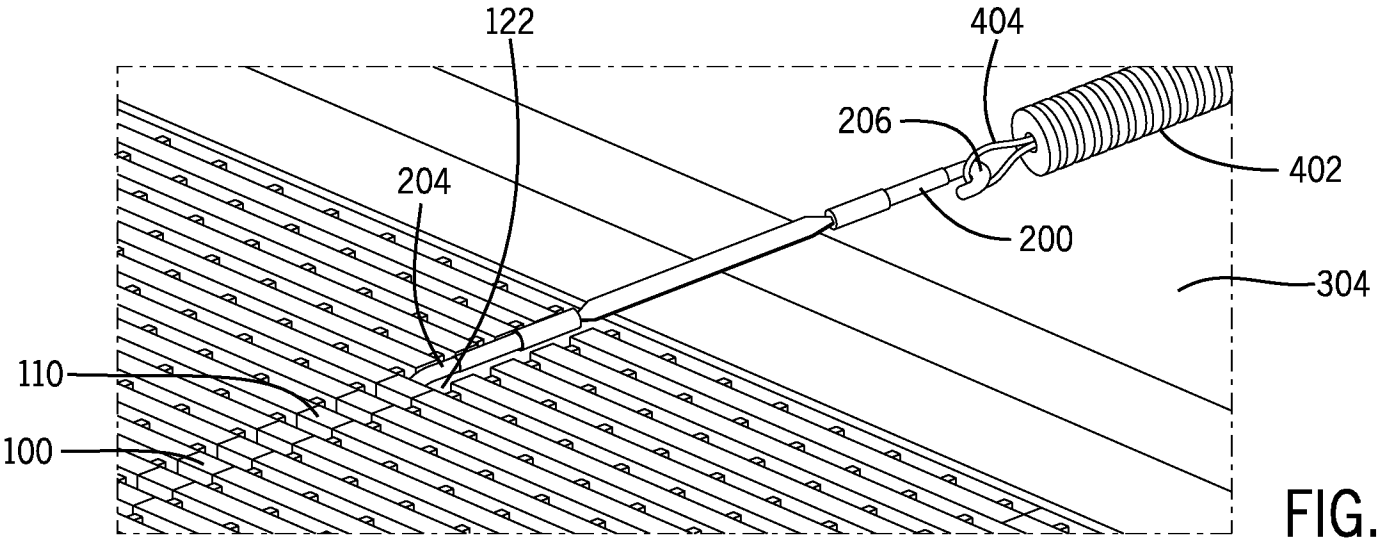
FIG. 4C shows a perspective view of the installed anchor of FIG. 3A, with the cover closed and the extension connector installed to engage a lane line.
Figure 4D:
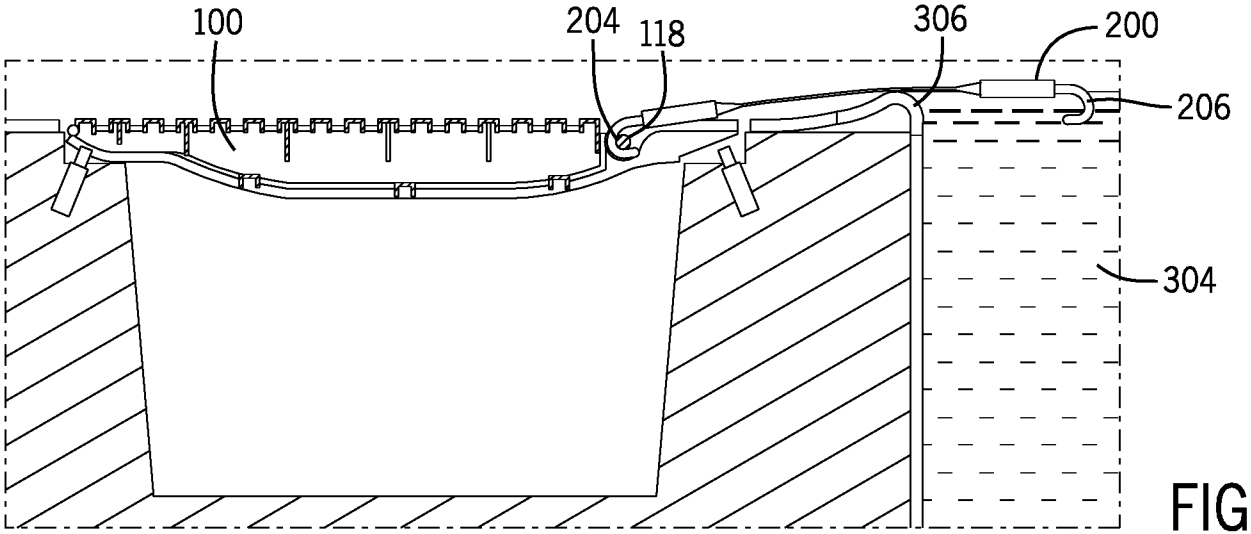
FIG. 4D shows a cross-sectional view of the arrangement of FIG. 4C.

FIGS. 4A-4D show the anchor 300 with the housing 100 in an anchor configuration. FIGS. 4A and 4B show the housing 100 installed on the surrounding surface 302 in the anchor configuration with the cover 104 of the housing body 102 open while FIGS. 4C and 4D show the housing 100 installed on the surrounding surface 302 in the anchor configuration with the cover 104 of the housing body 102 closed.

In the anchor configuration, the first connector 204 of the extension connector 200 (e.g., extension connector 200*a*, 200*b*, or other extension connector) can be coupled to the support member 118 of the housing 100. In some cases, for example, the extension connector 200 can have a hooked anchor end configured to engage the support member 118 of the housing 100 (see FIGS. 4B and 4D). Once the first connector 204 is engaged with the support member 118 of the anchor, the elongate central portion 202 of the extension connector 200 can extend out through opening 122 of the cover 104, away from the support member 118, and towards the water 304 of a swimming pool. The second connector 206 of the extension connector 200 can further be configured to couple to a corresponding structure 404 on a lane line 402 (shown schematically in FIG. 4C) in the water 304 of the swimming pool.

Thus, when coupled to the support member 118, the extension connector 200 can be secured against axial loading from a lane line (not shown) that is secured to a lane line end of the extension connector (e.g., opposite the anchor end). The lane line can then be held in place in a selected location in the swimming pool and thereby be prevented from floating away from the selected location.

As shown in FIGS. 4C and 4D, the cover 104 of the housing 100 can be pivoted closed to lock the extension connector 200 to the support member 118 of the housing 100. For example, the cover 104, in the closed configuration, may mechanically block the extension connector 200 from being disengaged from the support member 118 or being removed from the housing 100. In some examples, the cover 104 can be secured closed with press-fit, snap-fit, or other connection (e.g., with an articulable or other clasp, etc. (not shown)). Locking the extension connector 200 to the support member 118 of the housing 100 further ensures that the lane line can be held in place in the selected location in the swimming pool and that the lane line is prevented from floating away from the selected location.

As shown in FIGS. 4A-4D, when the housing 100 is in the anchor configuration, the extension connector 200 beneficially exhibits a relatively low profile when the extension connector extends along the surrounding surface 302. Further, the flexible character of the connector 200 can allow the installation to accommodate a variety of pool configurations, including those that include an optional lip 306 (e.g., tile lip, swimming pool deck lip, or the like) on the surrounding surface 302. In this regard, the protruding profile of the extension connector 200 can further be reduced if the flattened central portion 202*a* of the extension connector 200*a* is used.

Figure 5:
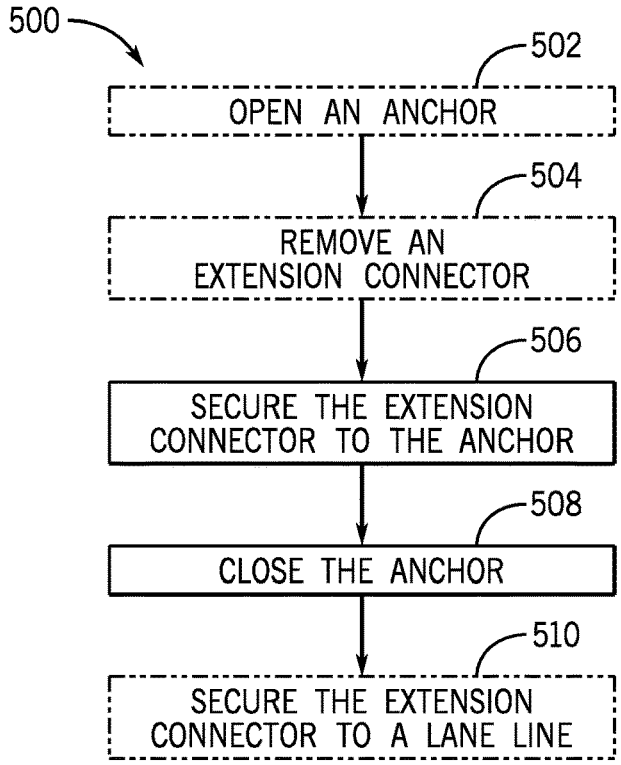
FIG. 5 schematically represents a method of securing a lane line for a swimming pool, according to an example of the disclosed technology.
Figure 6:
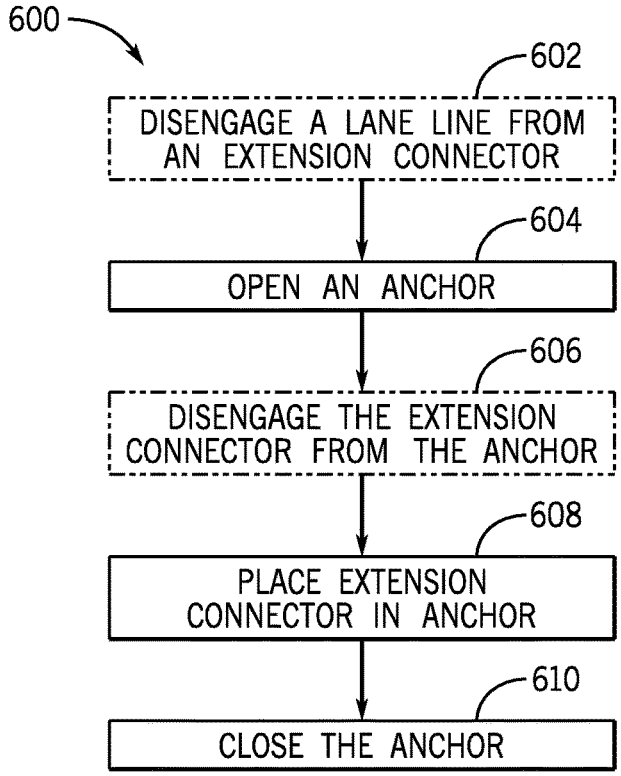
FIG. 6 schematically represents a method of storing an extension connector, according to an example of the disclosed technology.
Figure 7:
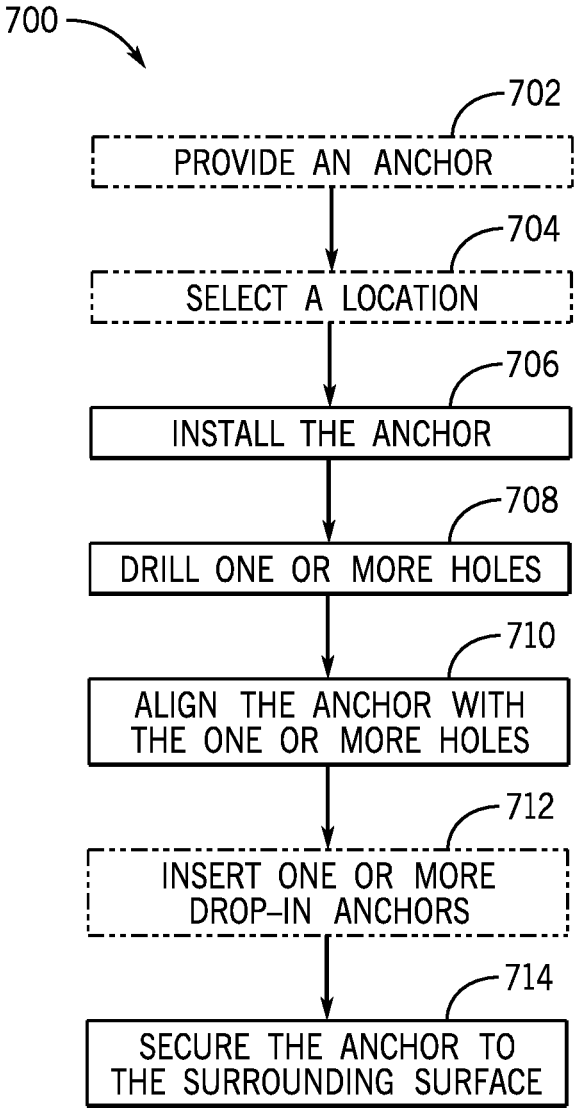
FIG. 7 schematically represents a method of installing an anchor, according to an example of the disclosed technology.

FIGS. 5-7 are flow diagrams representing different methods for using the housing 100 or installing the housing 100. FIGS. 5-7 are merely examples of different methods that can be used and a person of ordinary skill in the art would understand that other methods of use can be possible and within the scope of this disclosure.

In some examples, a method 500 might be used to securing a lane line for a swimming pool using the anchor and extension connector of FIGS. 1-4. The method can optionally include, at block (e.g., manual operation) 502, opening a cover of an anchor installed on a surrounding surface (e.g., swimming pool deck, swimming pool gutter, or the like) and optionally removing an extension connector from an internal cavity of a housing of the anchor at block 504. At block 506, a first end of the extension connector (e.g., an end that is more closed) can be secured to a support member within the internal cavity of the housing, with the cover of the housing in an open configuration.

At block 508, the method can include closing the cover of the housing to secure (e.g., lock) the first end of the extension connector within the internal cavity of the housing of the anchor, in engagement with the support member. A second end of the extension connector can extend outside of the housing through an opening. In some cases, at optional block 510, a lane line can then be secured to the second end (e.g., an end that is more open) of the extension connector. In some cases, however, the extension connector can simply be left in an extended configuration to be later engaged with a lane line.

In some examples, referring to FIG. 6, a method 600 might be used to store an extension connector in an anchor of FIGS. 1-4 (e.g., as initial operations or an extension of the method 500. The method can optionally include, at block (e.g., manual operation) 602, disengaging a lane line from a second end of the extension connector. The method can continue at block 604 with opening a cover of the housing of the anchor and, optionally, at block 606, disengaging a first end of the extension connector from a support member within an internal cavity of a housing of the anchor. Next, the extension connector can be placed inside the internal cavity of the housing on top of one or more extensions at block 608. At block 610, a cover of the housing can be closed. In this regard, for example, block 610 can also include aligning the cover to be flush with or substantially flush with a top surface of a surrounding surface.

In some examples, a method 700 might be used to install an anchor disclosed in FIGS. 1-4. Referring in particular to FIG. 7, the method can optionally include, at block 702, providing an anchor configured to be installed in a surrounding surface. Next, at block 704, the method can optionally include selecting a location on the surrounding surface to install the anchor (e.g., a location associated with lane lines for a swimming competition, a location associated with lane lines for water polo, or other selected location). At block 706, the method can include installing the anchor at a selected (or predetermined) location.

Figure 8A:
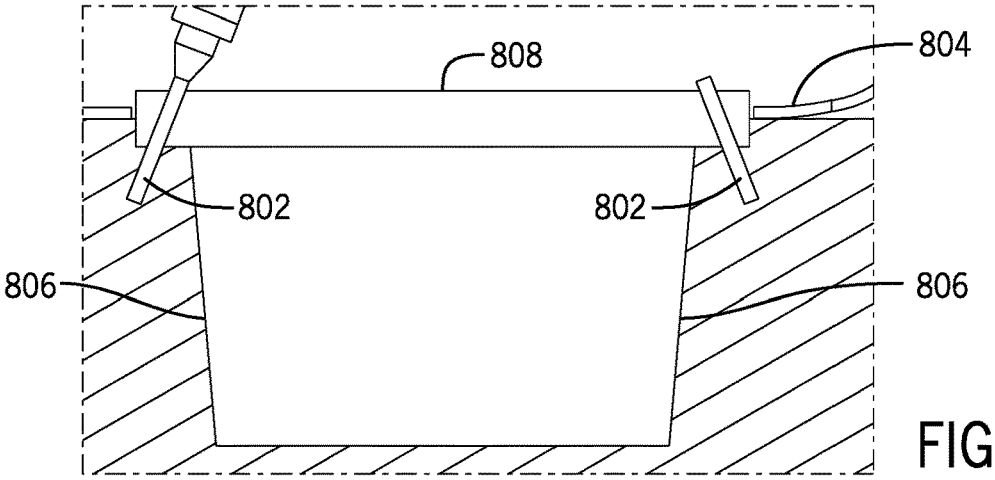
FIGS. 8A-8C are cross-sectional views illustrating certain example operations of the method FIG. 7.
Figure 8B:
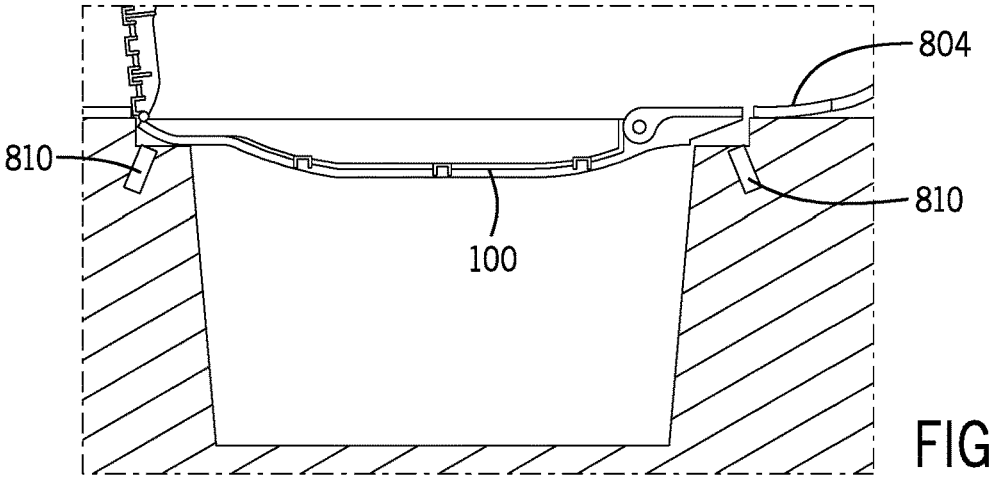
Figure 8C:
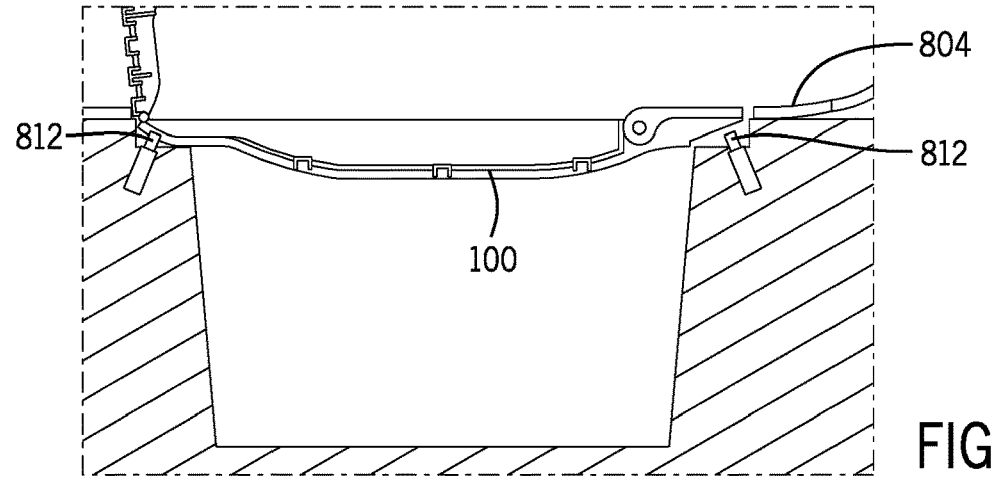

Referring now also to FIGS. 8A-8C, the method 700 can continue at optional block 708 to include drilling one or more drill holes 802 into the surrounding surface 804 as shown in FIG. 8A. The one or more drill holes 802 can be drilled such that the one or more drill holes 802 are angled into the thickness of the surrounding surface 804 and away from a sidewall 806 of the surrounding surface 804 (e.g., in opposite directions, obliquely relative to vertical). Angling the one or more drill holes into the thickness of the surrounding surface helps prevent the surrounding surface 804 and/or sidewall 806 from breaking and weakening the fastening. In some cases, a drilling template 808 or drill guide can be used to ensure the one or more drill holes are oriented (e.g., placed and angled) correctly in a selected location.

At block 710, one or more holes of the housing 100 (e.g., one or more holes 120) can be aligned with the one or more drill holes 802. In some cases, one or more drop-in (or other) fastening anchors 810 can be inserted into the one or more holes of the anchor and the one or more drill holes 802 at optional block 712 (shown in FIG. 8B). Additionally, at block 714, the housing 100 can be secured to the surrounding surface 804 using the one or more drill holes 802. In order to secure the anchor, one or more fasteners 812 (e.g., bolts, screws, socket head cap screws, or the like) can be inserted into the one or more holes of the anchor and the one or more drop-in anchors 810 or the one or more drill holes 802 to secure the housing 100 to the surrounding surface 804.

Thus, the disclosed technology can provide improved mechanisms to anchor lane lines or other objects relative to pool decks, gutters, or other structures. In particular, embodiments of the disclosed technology can be readily adapted for concrete gutter pools and stainless-steel gutter pools, and for a variety of gutter designs, including a wide variety of deck level, rim flow, roll-out and deep trough gutters that employ parallel grating, or pool deck designs. Some examples can be certified under NSF/ANSI/CAN 50-2020. Some examples can be rated for over 1000 pounds of pull weight. Further, as noted above, some designs can be used without requiring any bonding under NEC 680.26(c).

In some implementations, devices or systems disclosed herein can be utilized or installed using methods embodying aspects of the invention. Correspondingly, description herein of particular features or capabilities of a device or system is generally intended to inherently include disclosure of a method of using such features for intended purposes and of implementing such capabilities. Similarly, express discussion of any method of using a particular device or system, unless otherwise indicated or limited, is intended to inherently include disclosure, as embodiments of the invention, of the utilized features and implemented capabilities of such device or system.

As used herein, unless otherwise limited or defined, "or" indicates a non-exclusive list of components or operations that can be present in any variety of combinations, rather than an exclusive list of components that can be present only as alternatives to each other. For example, a list of "A, B, or C" indicates options of: A; B; C; A and B; A and C; B and C; and A, B, and C. Correspondingly, the term "or" as used herein is intended to indicate exclusive alternatives only when preceded by terms of exclusivity, such as "only one of," or "exactly one of." For example, a list of "only one of A, B, or C" indicates options of: A, but not B and C; B, but not A and C; and C, but not A and B. In contrast, a list preceded by "one or more" (and variations thereon) and including "or" to separate listed elements indicates options of one or more of any or all of the listed elements. For example, the phrases "one or more of A, B, or C" and "at least one of A, B, or C" indicate options of: one or more A; one or more B; one or more C; one or more A and one or more B; one or more B and one or more C; one or more A and one or more C; and one or more A, one or more B, and one or more C. Similarly, a list preceded by "a plurality of" (and variations thereon) and including "or" to separate listed elements indicates options of one or more of each of multiple of the listed elements. For example, the phrases "a plurality of A, B, or C" and "two or more of A, B, or C" indicate options of: one or more A and one or more B; one or more B and one or more C; one or more A and one or more C; and one or more A, one or more B, and one or more C.

Also as used herein, unless otherwise limited or defined, "lateral" in the context of a lane line indicates a direction that is transverse to an elongate direction of a lane line. Thus, for example, relative to a lane line that extends in a first direction across a pool, a lateral support in an anchor for the lane line may extend transverse to the first direction (e.g., perpendicular or substantially perpendicular—i.e., with 5 degrees of perpendicular to the first direction).

Also as used herein, unless otherwise limited or defined, "including," "comprising," or "having" and variations thereof are meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

Also as used herein, unless otherwise defined or limited, directional terms are used for convenience of reference for discussion of particular figures or examples. For example, references to downward (or other) directions or top (or other) positions may be used to discuss aspects of a particular example or figure, but do not necessarily require similar orientation or geometry in all installations or configurations.

Additionally, unless otherwise specified or limited, the terms "about" and "approximately," as used herein with respect to a reference value or ratio, refer to variations from the reference value or ratio of ±20% or less (e.g., ±15, ±10%, ±5%, etc.), inclusive of the endpoints of the range. Unless otherwise specified or limited, "about parallel" indicates a direction that is within 10 degrees of parallel to a reference direction.

The previous description of the disclosed embodiments is provided to enable any person skilled in the art to make or use the invention. Various modifications to these embodiments will be readily apparent to those skilled in the art, and the generic principles defined herein may be applied to other embodiments without departing from the spirit or scope of the invention. Thus, the invention is not intended to be limited to the embodiments shown herein but is to be accorded the widest scope consistent with the principles and novel features disclosed herein.

The invention claimed is:

1. An anchor for a lane line of a swimming pool, the anchor comprising:

a housing that includes a cover and a support member, the housing defining an internal cavity and the cover being movable to open and close the internal cavity; and an extension connector that engages the support member, wherein the extension connector includes a flattened central portion and the flattened central portion includes an internal web structure;

wherein, with the cover closed over the internal cavity, a first end of the extension connector is secured in engagement with the support member and a second end of the extension connector extends outside of the internal cavity to support a lane line.

2. The anchor of claim 1, wherein the extension connector includes a first hook that engages the support member and a second hook that engages the lane line.

3. The anchor of claim 1, wherein the flattened central portion extends to the outside of the internal cavity to overlay a section of a deck between the anchor and the swimming pool.

4. The anchor of claim 1, wherein the internal web structure is formed from a metallic webbing and the flattened central portion further comprises an outer sheath at least partially surrounding the metallic webbing.

5. The anchor of claim 4, wherein the outer sheath is formed from silicone.

6. The anchor of claim 1, wherein the support member includes a cross-member that extends laterally across the internal cavity.

7. The anchor of claim 1, wherein, in a storage configuration, the housing receives the extension connector fully within the internal cavity.

8. The anchor of claim 7, wherein the housing comprises one or more lateral supports and the extension connector rests on the one or more lateral supports in the storage configuration.

9. The anchor of claim 1, wherein the housing is recessed into a deck or a gutter that surrounds the swimming pool.

10. The anchor of claim 9, wherein, with the cover closed over the internal cavity, a top surface of the cover is substantially flush with a top surface of the deck or a cover of the gutter.

11. The anchor of claim 1, wherein the cover is pivotably coupled to the housing.

12. An anchor for a lane line of a swimming pool, the anchor comprising:

a housing that includes a cover and a support member, the housing defining an internal cavity and the cover being movable to open and close the internal cavity; and an extension connector that engages the support member:

wherein, with the cover closed over the internal cavity, a first end of the extension connector is secured in engagement with the support member and a second end of the extension connector extends outside of the internal cavity to support a lane line, wherein the extension connector includes a first hook that engages the support member and a second hook that engages the lane line, and wherein the first hook is more closed than the second hook.

13. A method of securing a lane line for a swimming pool, the method comprising:

with a cover of a housing of an anchor in an open configuration, securing a first end of an extension connector to a support member within an internal cavity of the housing of the anchor, wherein securing the first end of the extension connector to the support member includes engaging a first hook of the extension connector with a lateral cross-member within the housing;

closing the housing to secure the first end of the extension connector within the internal cavity, in engagement with the support member, with a second end of the extension connector extending outside of the housing, wherein securing the second end of the extension connector to the lane line includes engaging a second hook of the extension connector to the lane line; and securing a lane line to the second end of the extension connector.

14. A method of installing an anchor for a lane line of a swimming pool, the method comprising:

providing the anchor comprising:

a housing that includes a cover and a support member, the housing defining an internal cavity and the cover being movable to open and close the internal cavity; and an extension connector configured to engage the support member;

drilling one or more drill holes into a selected location relative to the swimming pool, wherein drilling the one or more drill holes includes drilling a first drill hole and a second drill hole extending at a respective oblique angle relative to vertical;

aligning one or more holes of a housing of the anchor with the one or more drill holes; and inserting one or more fasteners into the one or more holes of the housing and the one or more drill holes.

15. The method of claim 14, further comprising: with the cover of the housing in an open configuration, securing a first end of the extension connector to a support member within the internal cavity of the housing; and closing the housing to secure the first end of the extension connector within the internal cavity, in engagement with the support member, with a second end of the extension connector extending outside of the housing.

16. The method of claim 14, further comprising:

using a drilling template, drilling the first drill hole and the second drill hole of the one or more drill holes into a substrate that surrounds the swimming pool.

17. The method of claim 16, further comprising:

before aligning a first hole and a second hole of the one or more holes of the housing with the first and second drill holes, inserting fastening anchors into the first and second drill holes.

18. A method of installing an anchor for a lane line of a swimming pool, the method comprising:

providing the anchor comprising:

a housing that includes a cover and a support member, the housing defining an internal cavity and the cover being movable to open and close the internal cavity; and an extension connector configured to engage the support member;

drilling one or more drill holes into a selected location relative to the swimming pool, wherein drilling the one or more drill holes includes using a drilling template and drilling a first drill hole and a second drill hole of the one or more drill holes into a substrate that surrounds the swimming pool;

aligning one or more holes of a housing of the anchor with the one or more drill holes; and inserting one or more fasteners into the one or more holes of the housing and the one or more drill holes.

* * * * *